US007175443B2

(12) United States Patent
Mizuno et al.

(10) Patent No.: US 7,175,443 B2
(45) Date of Patent: Feb. 13, 2007

(54) ELECTRONIC APPARATUS WITH CONNECTOR OF CHANGEABLE ATTITUDE

(75) Inventors: Yusuke Mizuno, Kawasaki (JP); Sonomasa Kobayashi, Kawasaki (JP); Katsuichi Goto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/066,440

(22) Filed: Feb. 28, 2005

(65) Prior Publication Data

US 2006/0019513 A1 Jan. 26, 2006

(30) Foreign Application Priority Data

Jul. 21, 2004 (JP) ..... 2004-213309

(51) Int. Cl.
*H01R 12/00* (2006.01)

(52) U.S. Cl. ..... 439/76.1; 439/384; 439/92; 439/86; 439/374

(58) Field of Classification Search ..... 439/76.1, 439/384, 92, 95, 91, 86, 247, 248, 374, 382; 361/683, 686; 248/633, 634, 636, 638, 618
See application file for complete search history.

(56) References Cited

U.S. PATENT DOCUMENTS

| | | | | |
|---|---|---|---|---|
| 5,130,896 | A * | 7/1992 | Babb et al. | 361/818 |
| 6,099,325 | A * | 8/2000 | Parkhill | 439/76.1 |
| 6,146,209 | A * | 11/2000 | Francis | 439/676 |
| 6,233,140 | B1 * | 5/2001 | Cummings et al. | 361/683 |
| 6,283,438 | B1 * | 9/2001 | Shimada et al. | 248/694 |
| 6,290,513 | B1 * | 9/2001 | Kakinoki et al. | 439/108 |
| 6,339,531 | B1 * | 1/2002 | McKain et al. | 361/685 |
| 6,456,500 | B1 | 9/2002 | Chen | |
| 6,532,152 | B1 * | 3/2003 | White et al. | 361/692 |
| 6,560,092 | B2 * | 5/2003 | Itou et al. | 361/681 |
| 6,714,405 | B2 * | 3/2004 | Jitsukawa | 361/683 |
| 6,809,916 | B2 * | 10/2004 | Nakata et al. | 361/115 |
| 6,822,858 | B2 * | 11/2004 | Allgeyer et al. | 361/685 |
| 6,863,566 | B2 * | 3/2005 | Scheuerer | 439/587 |
| 2003/0171014 | A1 | 9/2003 | Lin | |

FOREIGN PATENT DOCUMENTS

| | | |
|---|---|---|
| DE | 200 08 357 | 9/2000 |
| JP | 8-6396 | 2/1996 |
| JP | 2001-209777 | 8/2001 |
| JP | 3096523 | 7/2003 |

OTHER PUBLICATIONS

German Official Communication, dated Dec. 23, 2005, for related German Patent Application 102005008139.8-53.

* cited by examiner

*Primary Examiner*—Gary F. Paumen
(74) *Attorney, Agent, or Firm*—Staas & Halsey LLP

(57) ABSTRACT

A connector is mounted on a printed circuit board in an enclosure. A member is interposed between the enclosure and the printed circuit board so as to hold the printed circuit board on the enclosure. The member allows change in the attitude of the printed circuit board relative to the enclosure. When the connector is coupled to the other connector, the connector receives a force from the other connector in the electronic apparatus. The force induces the change in the attitude of the connector and the printed circuit board. The change in the attitude in this manner enables consumption of the energy of the force within the member. Generation of stress can be suppressed in a bonding member such as a solder coupling the connector with the printed circuit board, for example. Generation of cracks can be prevented in the solder. Shockproof is improved for the connector.

14 Claims, 4 Drawing Sheets

ELECTRONIC APPARATUS WITH CONNECTOR OF CHANGEABLE ATTITUDE

BACKGROUND OF THE INVENTION

1. Field of the Invention

The present invention relates to a connector such as a Universal Serial Bus (USB) connector. In particular, the invention relates to an electronic apparatus including: an enclosure; a printed circuit board located on the enclosure within the enclosure; and a connector mounted on the printed circuit board.

2. Description of the Prior Art

A security key pursuant to the requirement of Universal Serial Bus (USB) is well known. When the security key is inserted into a USB connector of a personal computer, the boot of the personal computer is permitted. The security key is kept inserted during the operation of the personal computer. When the security key is withdrawn from the USB connector, the personal computer is locked. The locked personal computer will not accept any input.

The security key is frequently inserted into and pulled off from the personal computer. Every time the security key is inserted and pulled off, the USB connector of the personal computer suffers from a force acting from the security key. The USB connector is caused to move on the printed circuit board. This movement may induce a crack in solder that couples the USB connector to the printed circuit board.

Moreover, when the security key is kept inserted in the USB connector of the personal computer as mentioned above, the security key protrudes from the enclosure of the personal computer. Many objects collide against the security key during the operation of the personal computer. The impact of the collision is transmitted to the USB connector. This promotes generation of cracks in the solder.

SUMMARY OF THE INVENTION

It is accordingly an object of the present invention to provide an electronic apparatus capable of improving shockproof of a connector.

According to a first aspect of the present invention, there is provided an electronic apparatus comprising: an enclosure; a printed circuit board; a connector mounted on the printed circuit board; and a member interposed between the enclosure and the printed circuit board so as to hold the printed circuit board on the enclosure. The member allows change in the attitude of the printed circuit board relative to the enclosure.

When the connector is coupled to the other connector, the connector receives a force from the other connector in the electronic apparatus. The force induces change in the attitude of the connector and the printed circuit board. The change in the attitude in this manner enables consumption of the energy of the force within the member. Generation of stress can be suppressed in a bonding member such as solder that couples the connector with the printed circuit board, for example. Generation of cracks can be prevented in the solder. Shockproof is improved for the connector.

An elastic member may serves as the member interposed between the enclosure and the printed circuit board in the aforementioned electronic apparatus, for example. In this case, the enclosure may comprise: an enclosure body receiving the elastic member; and an auxiliary enclosure coupled to the enclosure body. The auxiliary enclosure may be designed to urge the connector and the printed circuit board against the elastic member. The connector and the printed circuit board are stably placed within the enclosure while change in the attitude thereof is allowed. The auxiliary enclosure may be a cover coupled to the enclosure body, an auxiliary cover partly covering the enclosure body, or the like.

The electronic apparatus preferably includes a stop designed to contact the connector at a plane upright to the surface of the printed circuit board. In this case, the stop is designed to support the force acting on the connector in a certain direction. If the other connector is connected to the connector in this certain direction, a complete connection can reliably be established between the connector and the other connector.

Otherwise, the electronic apparatus may further include: a first electrically conductive film formed on the back surface of the printed circuit board; a second electrically conductive film formed on the surface of the enclosure; and an electrically conductive elastic member interposed between the printed circuit board and the enclosure. The electrically conductive elastic member contacts the first and second electrically conductive films. Electric current is allowed to flow from the first electrically conductive film to the second electrically conductive film through the electrically conductive elastic member. The ground of the printed circuit board is in this manner reliably realized.

According to a second aspect of the present invention, there is provided an electronic apparatus comprising: an enclosure; a frame member disposed within an opening defined in the enclosure, said frame member allowing a grip to protrude out of the enclosure, said grip extending from a USB male connector; and a USB female connector defining a receiving opening at a position receding inside the enclosure from the frame member, said receiving opening receiving insertion of the USB male connector.

When the USB male connector is coupled with the USB female connector in the electronic apparatus, the grip of the USB male connector is supported at the frame member. Even if a force acts on the grip protruding from the enclosure, the displacement or movement of the grip can be suppressed. Only a reduced impact is transmitted to the USB female connector from the grip. The USB female connector is thus allowed to enjoy an improvement in shockproof. Moreover, since the grip protrudes from the enclosure, the user is allowed to easily pull out the grip and the USB male connector from the enclosure. In particular, the frame member is preferably made of a member separate from the enclosure.

The electronic apparatus may further include: a first guide surface intersecting a reference plane by a first inclination angle, said reference plane including the receiving opening; and a second guide surface connected to the rear end of the first guide surface, said second guide surface reaching the frame member along a plane intersecting the reference plane by a second inclination angle larger than the first inclination angle. The guide surfaces serve to reliably insert the USB male connector into the USB female connector. Electric connection can reliably be established between the USB male and female connectors.

Additionally, the USB female connector may be mounted on an elastic member on the enclosure in the electronic apparatus. Shockproof is further improved in the USB female connector.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
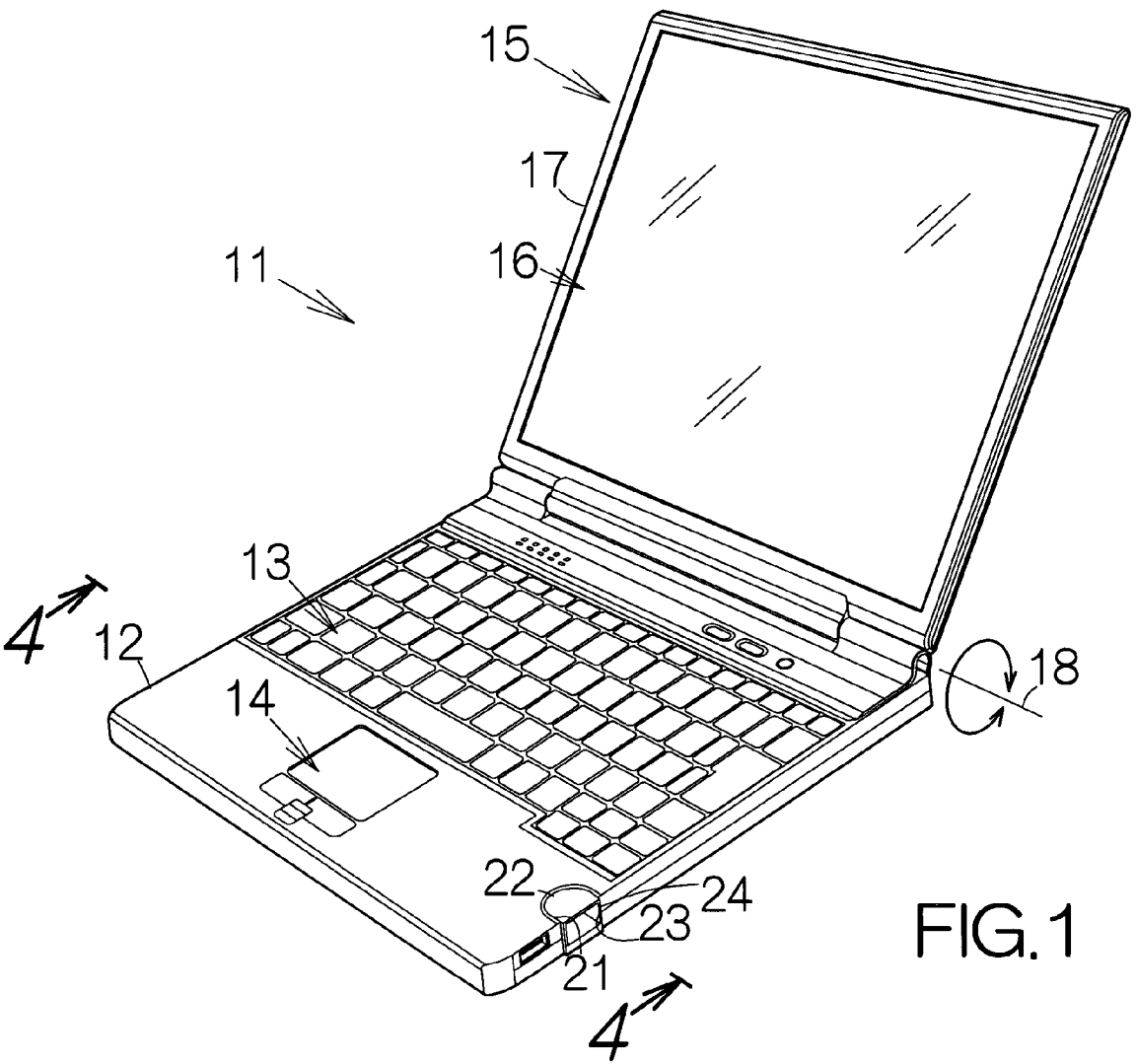
FIG. 1 is a perspective view schematically illustrating a notebook personal computer as a specific example of an electronic apparatus according to an embodiment of the present invention.

FIG. 1 schematically illustrates a notebook personal computer 11 as a specific example of an electronic apparatus according to an embodiment of the present invention. The notebook personal computer 11 includes a main body enclosure 12 containing a motherboard, for example. Electronic circuit elements such as a central processing unit (CPU), a memory unit, and the like, are mounted on the motherboard. The CPU is designed to execute various processings or calculations based on software programs and/or data temporarily stored in the memory, for example. The software programs and data may be stored in a mass storage such as a hard disk drive (HDD) enclosed within the main body enclosure 12.

Input devices such as a keyboard 13 as well as a pointing device 14 are incorporated in the main body enclosure 12. The user is allowed to input various instructions and data to the CPU through the input devices 13, 14. A so-called touch pad may be utilized as the pointing device 14, for example.

A display device 15 is coupled to the main body enclosure 12. The display device 15 includes a display enclosure 17 containing a flat display panel such as a liquid crystal display (LCD) panel 16, for example. The display enclosure 17 is coupled to the main body enclosure 12 for relative rotation around a rotation axis 18 located at the rear periphery of the main body enclosure 12. The display enclosure 17 is thus allowed to rotate relative to the main body enclosure 12. The rotation of the display device 15 enables the display device 15 to be superposed over the main body enclosure 12. Various text and/or graphics can be displayed on the screen of the LCD panel 16 in response to the operation of the CPU as well as the manipulation of the input devices 13, 14.

Figure 2:
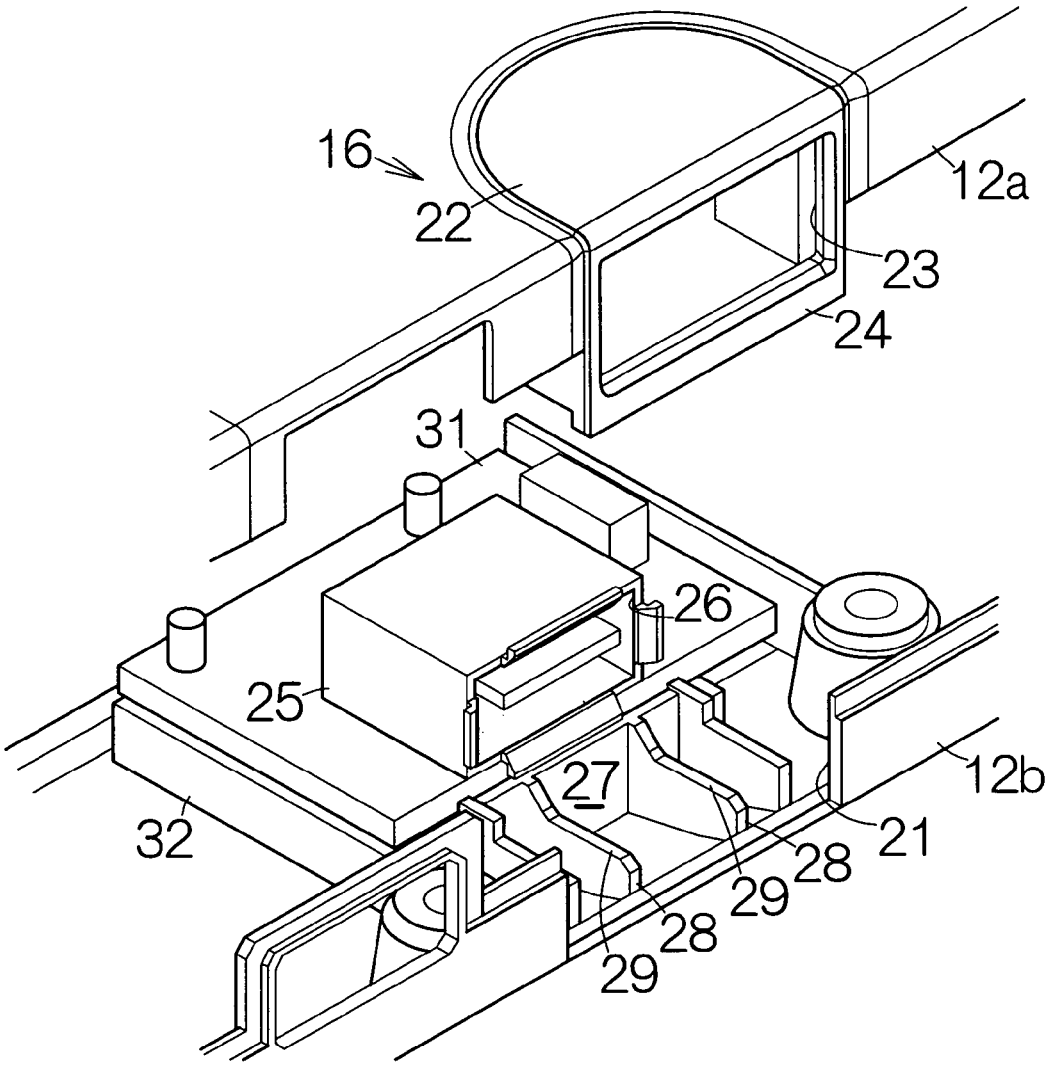
FIG. 2 is an exploded view of the notebook personal computer for schematically illustrating the structure of a Universal Serial Bus (USB) port.

An opening 21 is defined in the main body enclosure 12 for a Universal Serial Bus (USB) port. The opening 21 extends along a vertical reference plane. A reinforce member 22 is located within the opening 21. The reinforce member 22 includes a frame member 24 defining an insertion opening 23 within the opening 21. The insertion opening 23 is designed to receive insertion of a USB male connector. The insertion opening 23 extends along a vertical plane parallel to the aforementioned vertical reference plane. As shown in FIG. 2, the reinforce member 22 may be fixed to a cover 12*a* of the main body enclosure 12. The main body enclosure 12 defines an inner space between the cover 12*a* and a base 12*b*. The base 12*b* serves as an enclosure body of the present invention.

A USB female connector 25 is contained in the inner space within the main body enclosure 12. The USB female connector 25 defines a receiving opening 26 at a position receding inside the main body enclosure 12 from the frame member 24. The receiving opening 26 is designed to receive insertion of a USB male connector. The receiving opening 26 extends along a plane parallel to the aforementioned vertical reference plane.

A vertical wall 27 is formed on the base 12*b* of the main body enclosure 12. The vertical wall 27 extends to the surface of the base 12*b* from the periphery of the receiving opening 26. Reinforcing ribs 28 connected to the vertical wall 27. The reinforcing ribs 28 extend from the opening 21. Guide surfaces 29 are defined on the reinforcing ribs 28. The guide surfaces 29 are allowed to extend from the inside surface of the frame member 24 to the periphery of the receiving opening 26.

The USB female connector 25 is mounted on the printed circuit board 31. Protrusions and electrically conductive terminals, not shown, are designed to extend from the USB female connector 25. The protrusions and electrically conductive terminals are soldered to electrically conductive patterns spreading over the printed circuit board 31. An elastic member 32 is interposed between the printed circuit board 31 and the base 12*b* of the main body enclosure 12.

Figure 3:
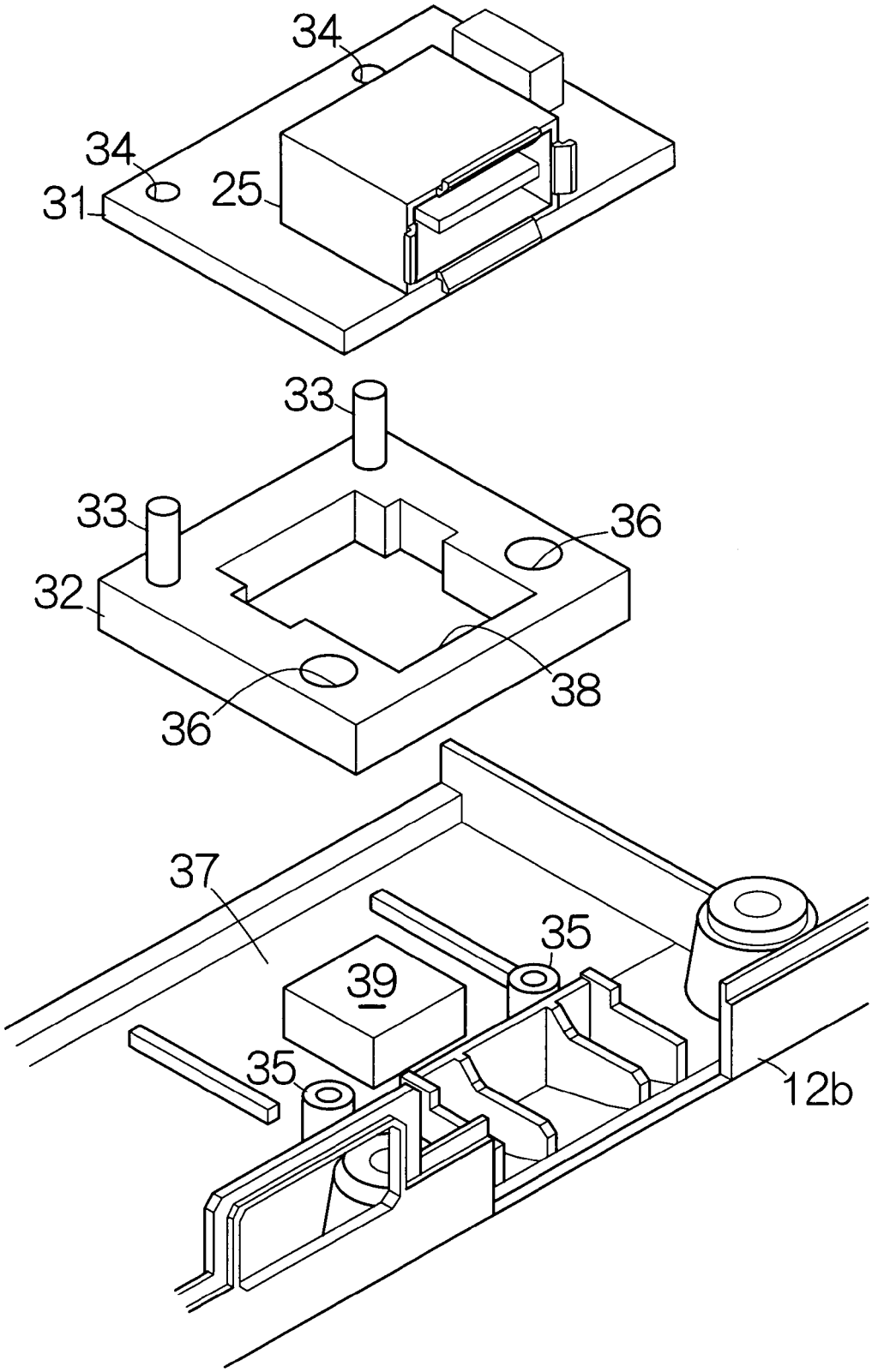
FIG. 3 is an exploded view schematically illustrating the structure for supporting the USB female connector.

As is apparent from FIG. 3, a pair of vertical column 33, 33 is integrally formed on the elastic member 32. A pair of through hole 34, 34 is correspondingly formed in the printed circuit board 31. When the printed circuit board 31 is placed on the elastic member 32, the vertical columns 33, 33 of the elastic member 32 are received into the through holes 34, 34. In this manner, the printed circuit board 31 is positioned on the elastic member 32.

A pair of boss 35, 35 is integrally formed on the base 12*b* of the main body enclosure 12. A pair of through hole 36, 36 is correspondingly formed in the elastic member 32. When the elastic member 32 is placed on the base 12*b*, the bosses 35, 35 of the base 12*b* are received in the through holes 36, 36. The elastic member 32 is in this manner positioned on the base 12*b*. The front surface of the elastic member 32 contacts the inside surface of the vertical wall 27.

An electrically conductive film 37 is formed over the inside surface of the base 12*b*. The elastic member 32 is placed on the electrically conductive film 37. Moreover, a hollow space 38 is defined within the elastic member 32. The hollow space 38 is designed to stand from the upper surface of the electrically conductive film 37. An electrically conductive elastic member 39 is placed within the hollow space 38. The electrically conductive elastic member 39 contacts the electrically conductive film 37 on the base 12*b*.

An electrically conductive film, not shown, is formed on the back or lower surface of the printed circuit board 31. This electrically conductive film serves as a ground. When the printed circuit board 31 is placed on the elastic member 32 on the base 12*b*, the electrically conductive film on the printed circuit board 31 contacts the electrically conductive elastic member 39. The electrically conductive elastic member 39 is interposed between the electrically conductive film 37 on the base 12*b* and the electrically conductive film on the printed circuit board 31. Electric current is thus allowed to flow from the electrically conductive film on the printed circuit board 31 to the electrically conductive film 37 through the electrically conductive elastic member 39. The ground of the printed circuit board 31 is in this manner reliably established.

Figure 4:
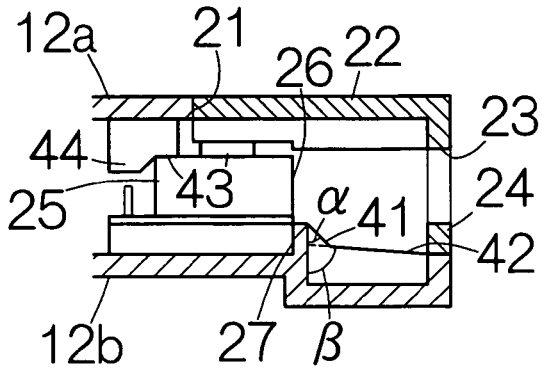
FIG. 4 is a partial sectional view taken along the line 4—4 in FIG. 1.

As shown in FIG. 4, a first guide surface 41 is defined on the guide surface 29 on the reinforcing rib 28. The first guide surface 41 is designed to intersect the vertical plane, including the receiving opening 26, by a first inclination angle α. The front end of the first guide surface 41 is connected to the vertical wall 27. A second guide surface 42 is defined at the rear of the first guide surface 41. The second guide surface 42 extends from the rear end of the first guide surface 41 to the frame member 24. The second guide surface 42 is designed to extend along a plane intersecting the vertical plane, including the receiving opening 23, by a second inclination angle β larger than the first inclination angle α.

A projection 43 is formed on the cover 12*a* of the main body enclosure 12. The projection 43 is designed to contact the USB female connector 25. When the cover 12*a* is coupled with the base 12*b*, the projection 43 urges the connector 25 and the printed circuit board 31 against the elastic member 32 on the base 12*b*. The connector 25 and the printed circuit board 31 is in this manner stably held in the main body enclosure 12. The elastic member 32 allows change in the attitude of the printed circuit board 31 and the connector 25. The projection 43 may be formed on the reinforce member 22 opposed to the connector 25 on the elastic member 32.

A stop 44 is formed on the cover 12*a* of the main body enclosure 12. The stop 44 is designed to contact the connector 25 at a plane upright from the upper surface of the printed circuit board 31. The stop 44 may be formed integral to the projection 43. The stop 44 receives an external force directed to the plane from the connector 25. The stop 44 serves to minimize the displacement or movement of the connector 25 to the plane. Moreover, since the stop 44 defines an inclined surface getting closer to the printed circuit board 31 at a position remoter from the connector 25, the external force acting on the connector 25 can be converted into a driving force directed to the elastic member 32.

Figure 5:
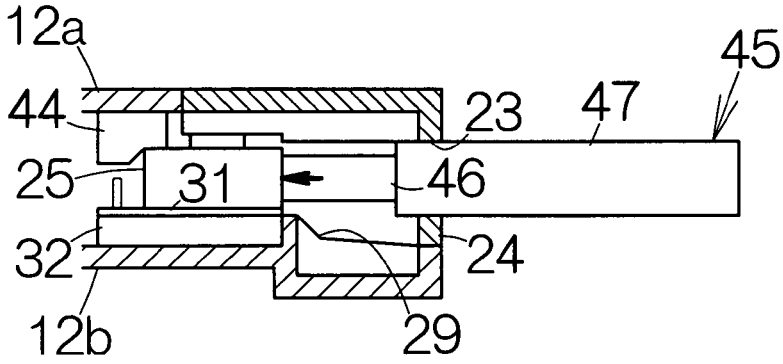
FIG. 5 is a partial sectional view, corresponding to FIG. 4, schematically illustrating the security key inserted into the USB port.

Now, assume that a USB security key is inserted into the receiving opening 23 of the frame member 24. As shown in FIG. 5, the USB security key 45 includes a USB male connector 46 designed to be received in a USB female connector. A grip 47 made of a resin material is connected to the rear end of the USB male connector 46. A memory chip such as a flash memory is contained within the grip 47, for example.

When the USB male connector 46 of the USB security key 45 approaches the USB female connector 25, the USB connector 46 is guided along the guide surfaces 29. When the USB security key 45 is then further inserted into the frame member 24, the USB male connector 46 is received in the USB female connector 25. A force acts on the USB female connector 25 in the inward direction of the main body enclosure 12 from the USB male connector 46. This force causes a change in the attitude of the USB female connector 25 along with the printed circuit board 31. The change in the attitude serves to convert the force into thermal energy within the elastic member 32. Generation of stress can thus be suppressed in a bonding member such as solder that couples the USB female connector 25 with the printed circuit board 31. Generation of cracks can be avoided in the solder.

The force in the inward direction of the main body enclosure 12 is also received on the stop 44. Retreat of the USB female connector 25 is thus prevented. The USB male connector 46 is allowed to completely get into the USB female connector 25. Electric connection is in this manner reliably established between the USB female connector 25 and the USB male connector 46.

Figure 6:
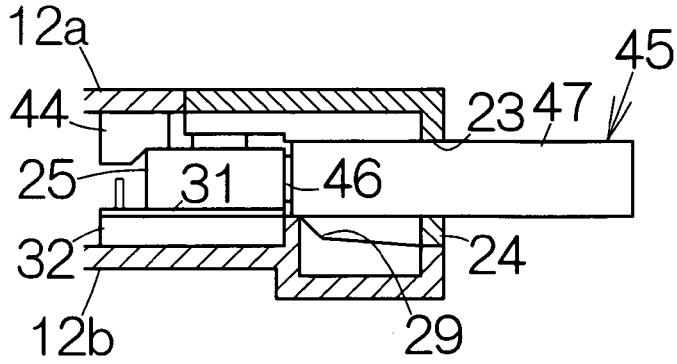
FIG. 6 is a partial sectional view, corresponding to FIG. 4, schematically illustrating the security key completely received in the USB port.

As shown in FIG. 6, when the USB male connector 46 has completely been received in the USB female connector 25, the frame member 24 supports the grip 47 of the USB security key 45. Even if any force is applied to the grip 47 protruding from the main body enclosure 12, displacement or movement of the grip 47 can be suppressed. Only a reduced impact is transmitted to the USB female connector 25 from the grip 47. Since the grip 47 protrudes out of the frame member 24, the user is allowed to easily pull out the USB security key 45 from the main body enclosure 12. If the USB security key 45 is completely sunk in the main body enclosure 12, an additional mechanism should be established to pull out the USB security key 45.

What is claimed is:

1. An electronic apparatus comprising:

an enclosure;

a printed circuit board;

a connector mounted on the printed circuit board; and an elastic member interposed between the enclosure and the printed circuit board so as to hold the printed circuit board on the enclosure, said elastic member allowing a change in attitude of the printed circuit board relative to the enclosure when a force is applied to the connector in use of the electronic apparatus.

2. The electronic apparatus according to claim 1, wherein said enclosure comprises:

an enclosure body receiving the elastic member; and an auxiliary enclosure coupled to the enclosure body, said auxiliary enclosure designed to urge the connector and the printed circuit board against the elastic member.

3. The electronic apparatus according to claim 2, wherein said auxiliary enclosure is a cover coupled to the enclosure body.

4. The electronic apparatus according to claim 1, further comprising a stop designed to contact the connector along a plane intersecting a surface of the printed circuit board.

5. The electronic apparatus according to claim 1, further comprising:

a first electrically conductive film formed on a back surface of the printed circuit board;

a second electrically conductive film formed on a surface of the enclosure; and an electrically conductive elastic member interposed between the printed circuit board and the enclosure, said electrically conductive elastic member contacting the first and second electrically conductive films.

6. An electronic apparatus, comprising:

an enclosure;

a frame member disposed within an opening defined in the enclosure, said frame member allowing a grip to protrude out of the enclosure, said grip extending from a USB male connector; and a USB female connector defining a receiving opening, at a position receding inside the enclosure from the frame member, said receiving opening receiving insertion of a USB male connector.

7. The electronic apparatus according to claim 6, wherein said frame member is made of a member separate from the enclosure.

8. The electronic apparatus according to claim 6, further comprising:

a first guide surface intersecting a reference plane by a first inclination angle, said reference plane including the receiving opening; and a second guide surface connected to a rear end of the first guide surface, said second guide surface reaching the frame member along a plane intersecting the reference plane by a second inclination angle larger than the first inclination angle.

9. The electronic apparatus according to claim 6, wherein said USB female connector is mounted on an elastic member on the enclosure.

10. An electronic apparatus comprising:

an enclosure;

a printed circuit board;

a first connector mounted on the printed circuit board; and an elastic member interposed between the enclosure and the printed circuit board so as to hold the printed circuit board on the enclosure, said elastic member undergoing elastic deformation, allowing a change in attitude of the printed circuit board relative to the enclosure, when a second mating connector is being merged with, and to be received by, the first connector.

11. The electronic apparatus according to claim 10, wherein said enclosure comprises:

an enclosure body receiving the elastic member; and an auxiliary enclosure coupled to the enclosure body, said auxiliary enclosure designed to urge the connector and the printed circuit board against the elastic member.

12. The electronic apparatus according to claim 11, wherein said auxiliary enclosure is a cover coupled to the enclosure body.

13. The electronic apparatus according to claim 10, further comprising a stop designed to contact the connector along a plane intersecting a surface of the printed circuit board.

14. The electronic apparatus according to claim 10, further comprising:

a first electrically conductive film formed on a back surface of the printed circuit board;

a second electrically conductive film formed on a surface of the enclosure; and an electrically conductive elastic member interposed between the printed circuit board and the enclosure, said electrically conductive elastic member contacting the first and second electrically conductive films.

* * * * *